US007938205B2

(12) United States Patent
Püttmann

(10) Patent No.: US 7,938,205 B2
(45) Date of Patent: May 10, 2011

(54) BORING HEAD METHOD AND BORING HEAD FOR A GROUND BORING DEVICE

(75) Inventor: Franz-Josef Püttmann, Lennestadt (DE)

(73) Assignee: Tracto-Technik GmbH, Lennestadt (DE)

( * ) Notice: Subject to any disclaimer, the term of this patent is extended or adjusted under 35 U.S.C. 154(b) by 464 days.

(21) Appl. No.: 11/571,751

(22) PCT Filed: Jul. 6, 2005

(86) PCT No.: PCT/EP2005/007286

§ 371 (c)(1),
(2), (4) Date: Oct. 27, 2008

(87) PCT Pub. No.: WO2006/002997

PCT Pub. Date: Jan. 12, 2006

(65) Prior Publication Data

US 2009/0211812 A1 Aug. 27, 2009

(30) Foreign Application Priority Data

Jul. 6, 2004 (DE) ..... 10 2004 032 551
Jul. 5, 2005 (DE) ..... 10 2005 031 707

(51) Int. Cl.
*E21B 10/40* (2006.01)

(52) U.S. Cl. ..... 175/389; 175/390; 175/414

(58) Field of Classification Search ..... 175/19, 175/298, 389, 390, 414, 381, 385, 415
See application file for complete search history.

(56) References Cited

U.S. PATENT DOCUMENTS

| | | | | |
|---|---|---|---|---|
| 1,929,608 | A * | 10/1933 | Rea | 76/108.2 |
| 2,054,255 | A * | 9/1936 | Howard | 175/298 |
| 3,708,023 | A * | 1/1973 | Nazarov et al. | 175/19 |
| 4,144,941 | A * | 3/1979 | Ritter | 175/19 |
| 4,681,161 | A * | 7/1987 | Arterbury et al. | 166/227 |
| 4,732,222 | A * | 3/1988 | Schmidt | 175/22 |
| 4,749,050 | A * | 6/1988 | Ritter | 175/19 |
| 4,809,789 | A * | 3/1989 | MacFarlane | 173/91 |
| 5,311,950 | A * | 5/1994 | Spektor | 175/19 |
| 5,377,770 | A | 1/1995 | Ritter et al. | |
| 5,467,831 | A | 11/1995 | Spektor et al. | |
| 6,343,842 | B1 * | 2/2002 | Sauer et al. | 299/79.1 |
| 7,216,726 | B2 * | 5/2007 | Swietlik et al. | 175/73 |
| 2004/0065482 | A1 * | 4/2004 | Larsson | 175/414 |
| 2007/0215388 | A1 * | 9/2007 | Kirk et al. | 175/327 |

FOREIGN PATENT DOCUMENTS

DE P 21 57 259.8-24 11/1971

(Continued)

*Primary Examiner* — David J Bagnell
*Assistant Examiner* — Catherine Loikith
(74) *Attorney, Agent, or Firm* — Henry M. Feiereisen; Ursula B. Day

(57) ABSTRACT

The invention relates to a boring head for a ground-boring device displacing earth with a percussive action, comprising at least three boring head sections, of which the first section has a form optimized for the loosening and for guiding the device, the second section is optimized with regard to the radial displacement of the earth with low resistance to motion, and the third section has a fixed connection to the housing of the ground-boring device. Improved transmission of the advancing forces to the earth and consequently an improved advance of the ground-boring device can be achieved by at least two of the boring head sections being designed so as to be axially movable relative to one another in the longitudinal direction.

30 Claims, 7 Drawing Sheets

FOREIGN PATENT DOCUMENTS

| | | | | |
|---|---|---|---|---|
| DE | 26 30 891 | A1 | | 1/1978 |
| DE | P 29 17 292 | | | 11/1980 |
| DE | 35 33 995 | A1 | | 4/1987 |
| DE | 40 14 775 | C1 | | 8/1991 |
| DE | 197 25 052 | A1 | | 12/1998 |
| DE | 198 23 629 | A1 | | 12/1999 |
| DE | 101 12 985 | A1 | | 10/2002 |
| GB | 2255361 | A | * | 11/1992 |

* cited by examiner

BORING HEAD METHOD AND BORING HEAD FOR A GROUND BORING DEVICE

CROSS-REFERENCES TO RELATED APPLICATIONS

This application is the U.S. National Stage of International Application No. PCT/EP2005/007286, filed Jul. 6, 2005, which designated the United States and has been published as International Publication No. WO 2006/002997 and which claims the priority of German Patent Applications, Serial No. 10 2004 032 551.0, filed Jul. 6, 2004, and Serial No. 10 2005 031 707.3, filed Jul. 5, 2005, pursuant to 35 U.S.C. 119(a)-(d).

BACKGROUND OF THE INVENTION

The invention relates to a boring head for a ground-boring device.

To produce boreholes in the field of horizontal boring, it is known to use "moles", which have a reciprocating percussion piston controlled via a drive fluid. This piston transmits its kinetic energy when striking a contact surface of the housing or of the boring head and drives the ground-boring device step by step through the earth.

In this case, the boring head of the device fulfills two functions. Firstly, said boring head transmits the percussion energy of the percussion piston to the earth situated in front of it and loosens the latter. Furthermore, the loosened earth is to be laterally displaced, so that a borehole having the desired diameter is obtained. In addition, the boring head, due to special shaping, is to be provide for guidance and consequently for directional stability of the device.

To fulfill these tasks, various boring head forms have been developed.

Firstly, the prior art (for example DE 21 57 259 C) has disclosed boring heads having a conical parent body. Said boring heads are distinguished by the fact that the conical lateral surface, which is as smooth as possible, has minimum resistance to the direction of movement.

The conical boring heads partly have recesses in the direction of the longitudinal axis of the device. The loosened earth is transported outward through these recesses.

These boring heads have the disadvantage of low directional stability, so that the device is deflected from the desired path by lateral forces which are produced by striking an obstacle or by inhomogeneity within the earth.

In addition to the conical boring heads, "stepped heads" are known (for example from DE 101 12 985 A1). The stepped heads also have a diameter which increases from the tip but in a stepped manner. In longitudinal section, a boring head of this type therefore has two steps which meet at the tip of the head. By the lateral surface being divided into a multiplicity of sections, which run either (virtually) parallel to or perpendicularly to the longitudinal axis of the device, only small lateral forces occur at the boring head, so that stepped heads have good directional stability. A disadvantage is that high resistance to motion occurs in the advancing direction due to the stepped surfaces situated perpendicularly to the longitudinal axis. This results in a correspondingly reduced rate of advance.

Furthermore, it is known from DE 101 12 985 A1 to design the boring head or a plurality of elements of the boring head so as to be movable relative to one another in order to achieve more specific introduction of the percussion energy available.

Furthermore, DE 29 17 292 A1 discloses a rock-fragmenting tool for percussion machines, the boring head of this tool, in the front region, consisting of a number of cutters arranged in a star shape. The intermediate spaces between the cutters serve as discharge passages for excavated rock. Following behind the cutters of the boring head is a conical section of the boring device, this conical section deflecting the excavated rock in the direction of the borehole wall, where it is blown out through an annular gap between the borehole wall and the housing of the device.

SUMMARY OF THE INVENTION

Based on this prior art, the object of the invention is to provide a boring head which is advantageous in particular for use in displaceable soils and which in particular combines advantages of the conical boring head—for example low resistance to motion—with advantages of the stepped head—for example high directional stability.

This object is achieved by the subject matter of the independent claims. Advantageous configurations are claimed by the subclaims.

The invention provides for the boring head to be formed from at least three boring head sections.

The first boring head section, which is situated nearest to the front end of the device, has discharge passages and can serve to loosen the earth or to shatter obstacles. The loosened or shattered earth can be directed through the discharge passages in the first boring head section toward the rear in the direction of second head section and also outward, depending on the design.

The expression "boring head" within the scope of the invention refers in particular to the tool at the head end of a ground-boring device, which tool can serve to produce and widen bores and lines already laid.

The expression "discharge passages" refers to recesses or recessed sections or holes which do not run transversely to the longitudinal direction of the ground-boring device. In this case, the expressions "recess" and "hole" are not restrictive from the production point of view, but rather are to be understood geometrically, so that recesses or holes according to the invention can also be produced by addition to the structure.

It is especially advantageous if the discharge passages, depending on the design of the ground-boring device, are arranged at an angle of between 0° and 45° to the longitudinal direction of the ground-boring device.

The second boring head section having one or more largely conical sections on the lateral surface can provide for the radial compaction of the loosened earth. However, the effect according to the invention can also be achieved with any other desired geometries.

The expression "largely conical form" refers in particular to a lateral surface which—at least partly—rises from a small radial extent continuously up to a larger radial extent and therefore does not have any sections within the conical region in which the radius is reduced again.

The third boring head section is designed for fastening the entire boring head to the housing of a ground-boring device. This fastening may be effected directly or indirectly, i.e. via intermediate elements.

The subdivision of the boring head into the various sections is to be seen in particular from the functional point of view, so that it is not necessary for there to be a structural separation of all the sections in each embodiment according to the invention.

A special advantage of the boring head according to the invention lies in the fact that the loosening work or the shattering work is first of all performed by a leading boring head section whose shaping has been optimized for this task. The preferred combination of the chisel point with blades arranged in a star shape provides for a high shattering capacity of the first head section with at the same time low resistance to motion. Due to the absence of large surfaces lying obliquely (not perpendicularly) to the direction of movement, the reaction of the first boring head section to isolated lateral forces as a result of obstacles on one side turns out to be slight.

The second boring head section compacts the loosened and shattered earth, which is directed through the recesses behind the first head section. Due to the largely conical shaping (of sections) of the second head section, this second head section is designed in an especially effective manner for the radial displacement of the earth with at the same time low resistance to motion.

Such a boring head, then, is used according to the invention for displacement bores in correspondingly displaceable soils. In particular, this may be effected advantageously when producing horizontal bores.

According to the invention, the expression "displacement bore" refers to a bore which is essentially based on the production of a borehole by radial displacement of the surroundings, the correspondingly "displaceable soil" being essentially plastically deformed and the soil structure remaining essentially in the deformed state due to adhesion or other physical effects.

The inherent disadvantage of this head form—the high sensitivity to introduction of force on one side, which does not become noticeable during rock drilling—is largely compensated for by virtue of the fact that the first head section can already have destroyed obstacles that appear and furthermore by virtue of the fact that the second boring head section only follows the direction predetermined by the first section.

In order to achieve specific transmission of the percussion energy of the ground-boring device to the earth, provision may be made according to the invention for at least two of the boring head sections to be axially movable relative to one another in the longitudinal direction (with respect to the longitudinal axis of the ground-boring device).

An advantageous embodiment provides for the first and the second boring head section to be designed to be movable relative to one another. Here, provision is preferably made for the second boring head section to be designed to be fixed—at least axially in the longitudinal direction—relative to the third boring head section. This enables the first head section to be advanced into the earth to begin with. In the process, the earth is loosened and shattered and directed toward the rear. The subsequently advanced second head section compacts the loosened earth and therefore produces the desired diameter of the borehole. Due to the fixed connection to the third boring section or to the housing of the ground-boring device, said housing is carried along at the same time.

A special advantage of this embodiment is that, during the advance of the first boring head section, the housing and the second and the third head section are not accelerated to begin with, so that a large proportion of the kinetic energy of the percussion piston is transmitted into the earth in order to shatter and loosen the latter.

An alternative embodiment may provide for the first and the second boring head section to be fixedly connected (at least axially in the longitudinal direction) and for this unit to be movable relative to the third boring head section. In this case, the functions of the first head section—in particular the loosening, shattering and discharge of the earth—and those of the second head section—in particular the radial compaction of the loosened earth—are performed in a joint operation. All the energy transmitted by the percussion piston of the ground-boring device may be used for this purpose. The ground-boring device per se is not moved up until during a second step when the third boring head section connected to the housing is advanced.

Furthermore, it may be advantageous to design all three boring head sections to be axially movable relative to one another in the longitudinal direction. Owing to the fact that the three head sections are advanced one after the other, even more specific introduction of the percussion force of the ground-boring device into the earth can be achieved.

Due to the specific introduction of the drive energy into the earth in the case of boring heads according to invention having boring head sections movable relative to one another also suitable for use in any desired soils.

It is advantageous if the discharge passages of the first boring head section are dimensioned in such a way that a multiplicity of uniformly distributed blades having a small wall thickness are produced. The thin blades provide for a pronounced cutting action, whereas generous dimensioning of the discharge passages provide for removal of the earth with little resistance.

The front edges (in the advancing direction) of the blades are preferably oriented essentially perpendicularly to the longitudinal axis of the boring head. As a result, lateral forces caused by striking an obstacle, which would cause the boring device to deviate from the desired direction, are avoided.

Within the scope of the invention, it is not necessary for the discharge passages to run continuously from the front side of the first boring head section up to its rear side. On the contrary, the discharge passages may run out inside the first boring head section, or the first boring head section may consist of two halves, which are both provided with discharge passages or blades, but are rotationally offset from one another. A blade of the rear half of the first boring head section can therefore be arranged behind each discharge passage of the first half.

In this way, solid bodies that have not been shattered by the front half encounter the blades of the rear half.

Furthermore, it may be advantageous if the diameter of the first boring head section essentially corresponds to the diameter of the following housing of the boring device. This enables the earth to be loosened by the blades of the first boring head section in a cross section which corresponds essentially to that of the housing of the boring device. As a rule, the housing diameter and therefore the loosened diameter corresponds to the nominal diameter of the bore to be produced.

In particular, the boring head sections may be dimensioned in such a way that the largest diameter of the first boring head section is greater than the smallest diameter of the second boring head section. Due to this jump in diameter, as well as due to the optional movement of the two head sections relative to one another, a relaxation space in which the loosened earth can relax again within limits for the time being is produced between said head sections.

Furthermore, it may be advantageous to make the largest diameter of the first boring head section larger than that of the housing. This ensures that a sufficient volume within the earth is loosened and consequently the resistance to motion which acts on the housing is reduced.

The first head section may have a percussion bolt or be connected to one. The percussion bolt in turn may have a chisel point which projects into the earth and by means of which the percussion energy can be introduced in a specific manner into the earth located in front of the boring head. In particular, obstacles, for example stones in the earth, can be shattered in a simple manner by the point-like introduction of force thus effected.

In an advantageous embodiment, the percussion bolt passes through the second and/or the third head section and can therefore serve as a guide for a relative movement of these head sections, provided the latter are designed to be axially movable relative to the first head section in the longitudinal direction.

If the first and the second head section form a fixed unit (axially in the longitudinal direction), the percussion bolt can of course also be connected to the second head section.

It is especially advantageous in this case if a percussion piston of the ground-boring device, which percussion piston is driven in a reciprocating manner by a pressure fluid, first of all strikes a contact surface of the percussion bolt and therefore transmits the percussion energy to the chisel point and the first or the first and the second boring head section.

The percussion energy is not transmitted to the third head section or to the housing, connected thereto, of the device until during a second step. To this end, the percussion piston, after a further forward movement of the percussion bolt, can strike a contact surface of the housing or of the second head section.

Alternatively, the percussion bolt may have a contact surface which strikes a corresponding contact surface of the housing/third head section after a certain forward movement.

During a three-stage advance of the boring device, the three head sections are accordingly acted upon one after the other—indirectly or directly—by the percussion piston of the boring device.

In an advantageous embodiment, the connection between the third head section and the housing is made in a positive-locking manner. This is advantageous in particular with regard to the ease of maintenance. The boring head can be exchanged quickly and simply. Threaded connections and/or bayonet fasteners are advantageously suitable for this purpose. Any other desired positive-locking or even frictional types of connection are possible.

Alternatively, the connection may also be produced by welding, for which the friction welding process in particular is suitable. The connection by welding is suitable in particular when a short overall length of the device is required.

However, every type of component connection can be used in addition to types mentioned here, and the connection is also not restricted with regard to the welding process.

In an especially advantageous configuration, the loosened earth is mixed with oil, bentonite or another fluid behind the first boring head section. However, fluid may also be introduced in front of the first head section.

For this purpose, bores may be provided in the housing or in one of the head sections, said bores introducing the fluid used preferably radially into the loosened earth.

The mixing of the earth with fluid can serve to reduce the lateral surface friction of the pulled-up housing. In addition, it can increase the cohesion of the displaced earth, so that the stability of the borehole is improved and collapse of the borehole occurs to a reduced extent.

BRIEF DESCRIPTION OF THE DRAWING

The present invention is explained in more detail below with reference to exemplary embodiments shown in the drawings, similar parts of the various embodiments being provided with identical reference numerals.

In the drawings.

DETAILED DESCRIPTION OF REFERRED EMBODIMENTS

Figure 1:
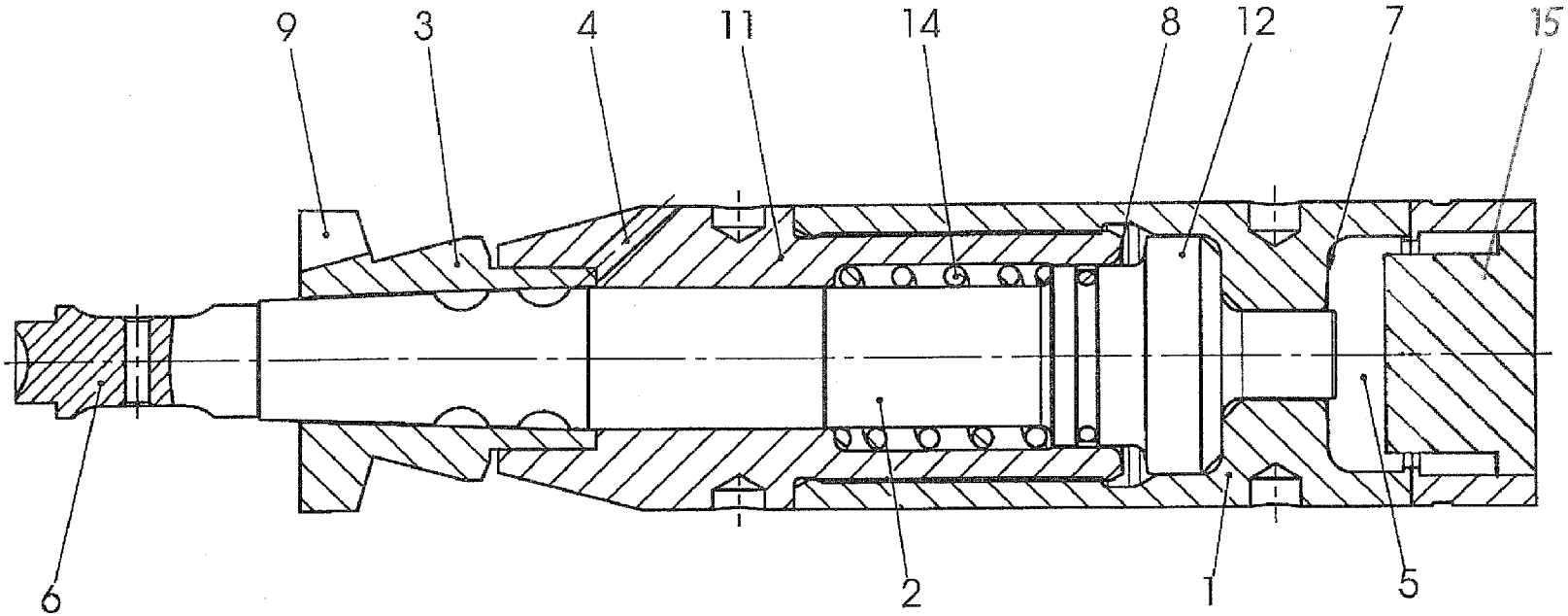
FIG. 1 shows a detail of a ground-boring device with a boring head according to the invention in a first embodiment, in a sectional side view.

FIG. 1 shows the front part of a ram boring device, consisting of a housing 1 and a boring head according to the invention connected thereto, in a first embodiment.

The boring head essentially comprises the following components: percussion bolt 2, cutting ring 3 and displacer 4. In this embodiment, the percussion bolt 2 and cutting ring 3 together form a first boring head section which is axially movable relative to the second head section, here in the form of the displacer 4, and the third head section 11. To this end, the displacer 4 and the third head section 11 are guided on the percussion bolt 2.

The rear end of the percussion bolt 2 projects into a working space 5 of the housing 1 in which a percussion piston 15, driven by a pressure fluid, moves in a reciprocating manner. For the forward movement of the ram boring device, the percussion piston 15 first of all strikes that end of the percussion bolt 2 which projects into the working space 5 and accelerates said percussion bolt 2 in the forward direction. Consequently, the percussion bolt 2 together with the chisel point 6 and the cutting ring 3 is driven into the earth in order to loosen the latter or in order to shatter obstacles that appear.

Both the displacer 4 and the housing 1 are not moved along to begin with.

Depending on the design of the device, the percussion piston 15, after a certain movement of the percussion bolt 2 relative to the housing 1 or relative to the displacer 4, strikes the contact surface 7 of the housing 1, or the step 12 of the percussion bolt 2 strikes the contact surface 8 of the displacer component 4. As a result, the housing 1 is accelerated together with the displacer 4 and follows the movement of the cutting ring 3. In the process, the displacer 4 compacts the loosened earth and produces a borehole having the diameter of the housing 1.

Figure 2:
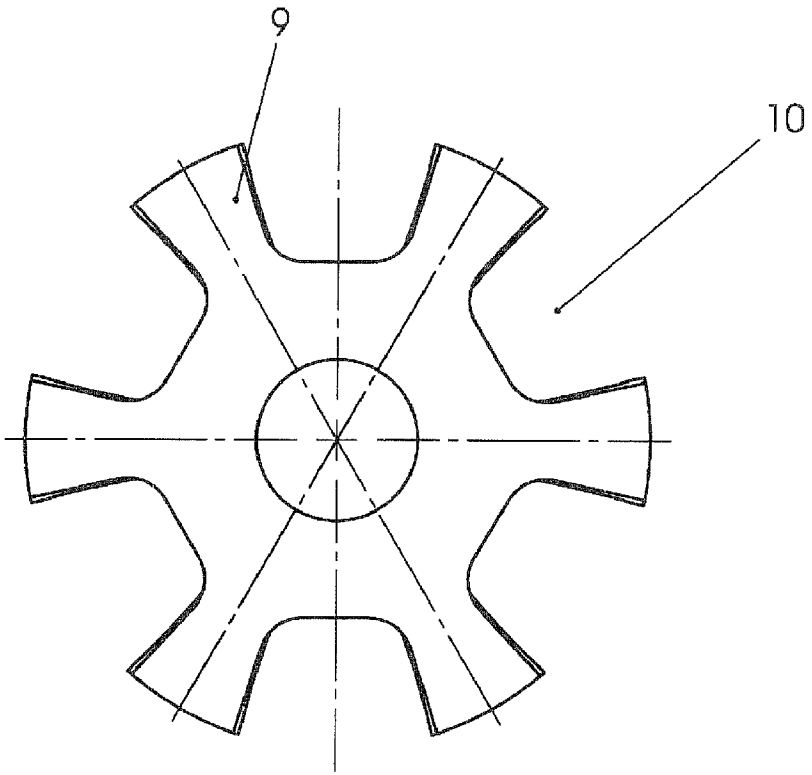
FIG. 2 shows a component of the first boring head section of the embodiment from FIG. 1 in a front view.

FIG. 2 shows the radial arrangement of the blades 9, which are produced by appropriate dimensioning of the discharge passages 10.

After completion of a motion stroke, a spring 14, here in the form of a helical spring, assists the full retraction of the two parts of the boring head movable relative to one another into the initial position.

The boring head according to the invention is designed in such a way that it can be inserted into the housing 1 as a unit from the front and can be fixed there. This is especially advantageous for maintenance activities that become necessary, since the boring head has the components subjected to the greatest stress and is consequently subjected to the highest wear during operation. Simple exchange of the boring head is therefore possible.

In addition, depending on the requirements, boring heads having various forms, as shown, for example, in FIGS. 3 to 7, can be connected to the housing quickly and simply.

Figure 3:
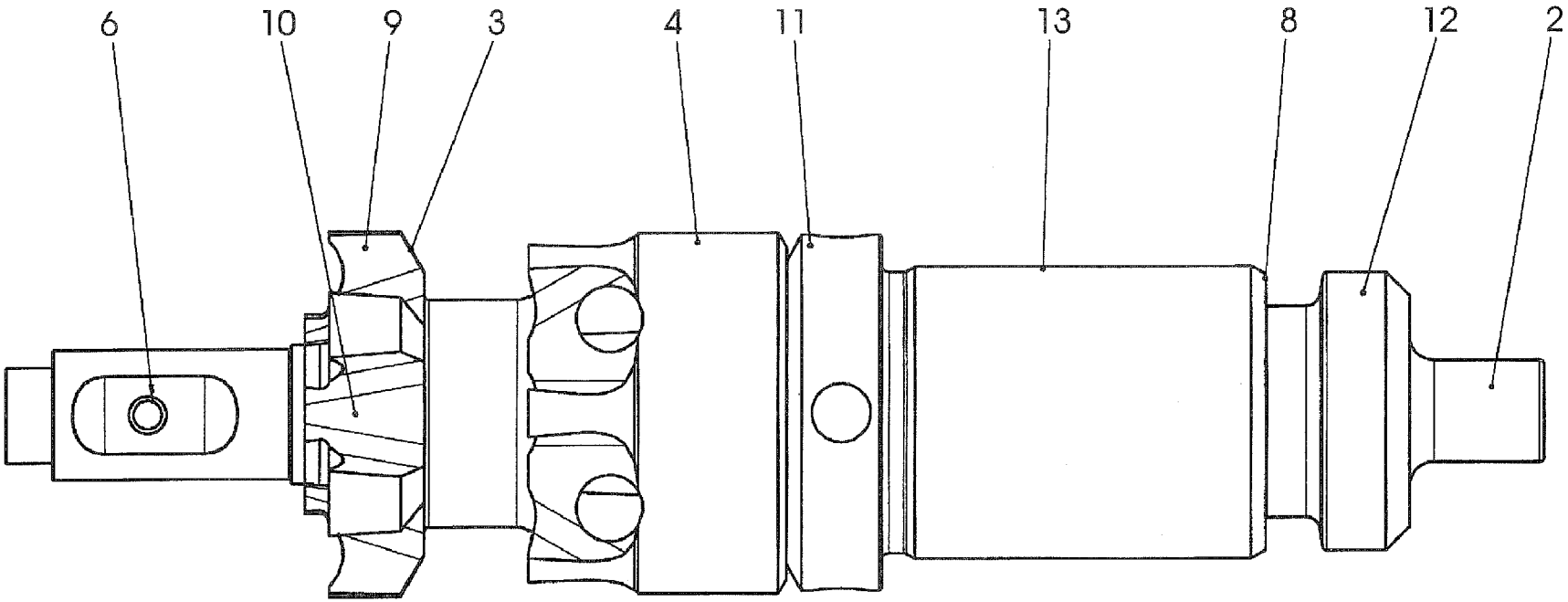
FIG. 3 shows a second embodiment of a boring head according to the invention in a perspective side view.
Figure 4:
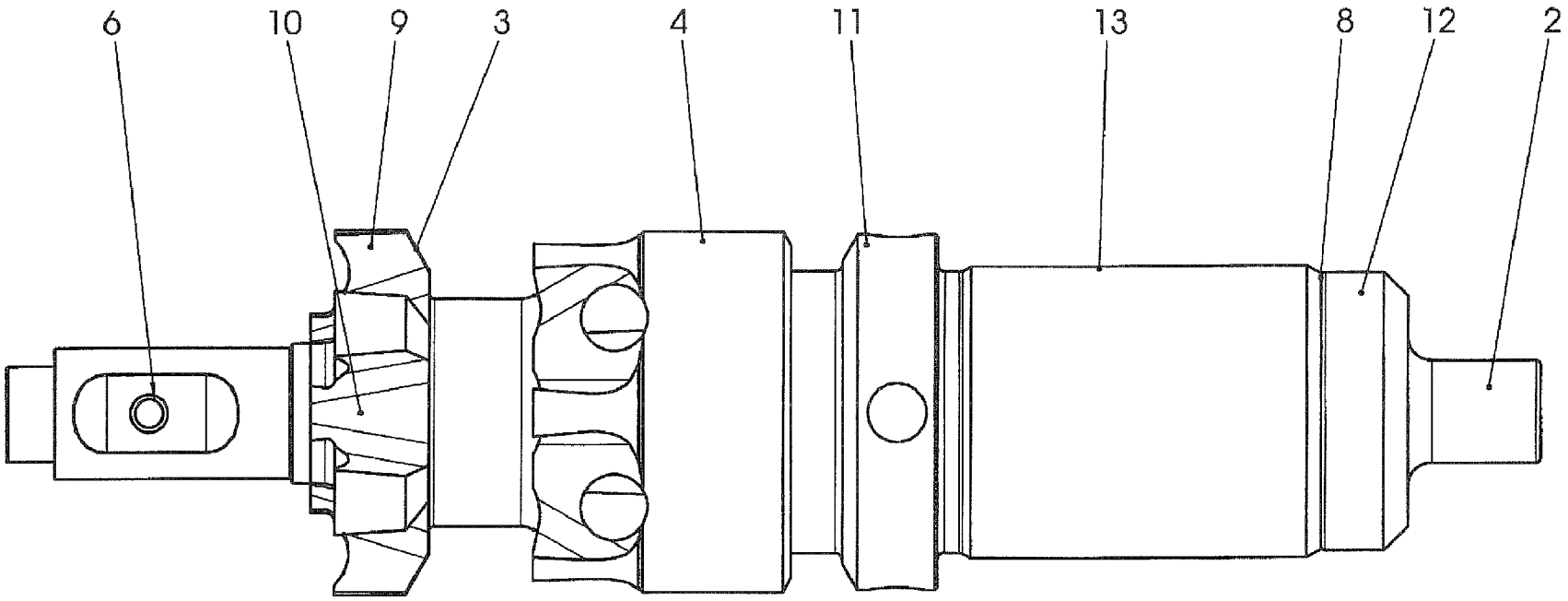
FIG. 4 shows the boring head according to FIG. 3, the movable part of the boring head being shown in the leading position.

FIGS. 3 and 4 show an alternative embodiment of the boring head according to the invention. Here, the first boring head section (cutting ring 3) and the second boring head section (displacer 4) are designed as a unit firmly connected together. Furthermore, this unit is connected to the percussion bolt 2, which in turn serves as a guide for the third head section 11 movable axially relative to the other head sections. The third head section 11 is connected to the housing of a boring device via the thread 13.

The displacer 4 differs from that of the first embodiment in particular to the extent that it has only individual conical sections. The latter are interrupted by further blades, which are arranged in alignment with a respective discharge passage 10 of the cutting ring 3.

FIGS. 3 and 4 show the same embodiment in different positions. In FIG. 3, the movable part of the boring head is shown in its retracted position. The clearance provided between the step 12 of the percussion bolt 2 and the striking surface 8 of the third boring head section 11 can clearly be seen. At the same time, the clearance between the second and the third boring head section is minimal. In FIG. 4, the movable part of the boring head is shown in the leading position. Accordingly, the clearance between step 12 and striking surface 8 is minimal and the clearance between the second and the third boring head section is at a maximum.

Figure 5:
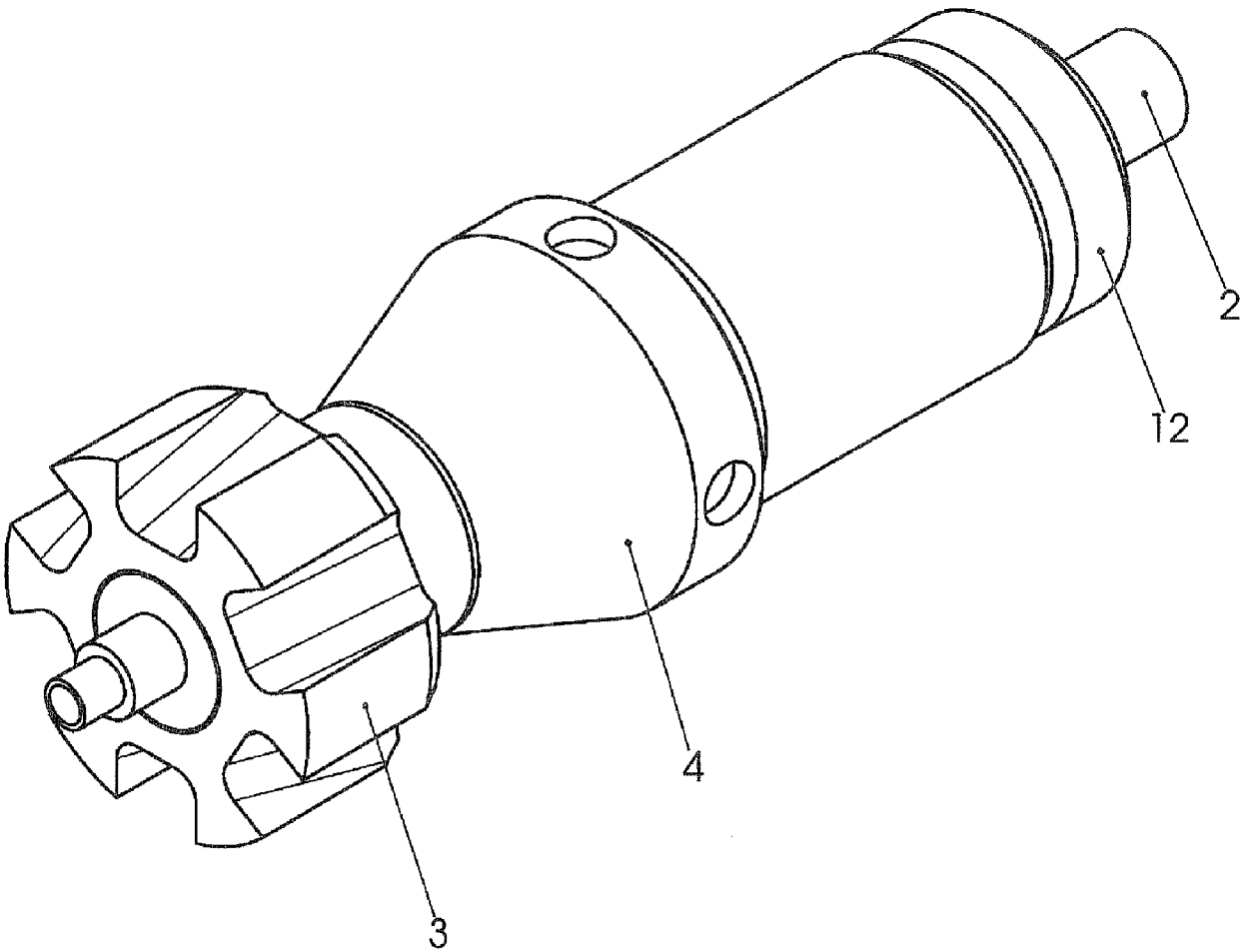
FIG. 5 shows a third embodiment of a boring head according to the invention in a perspective view.
Figure 6:
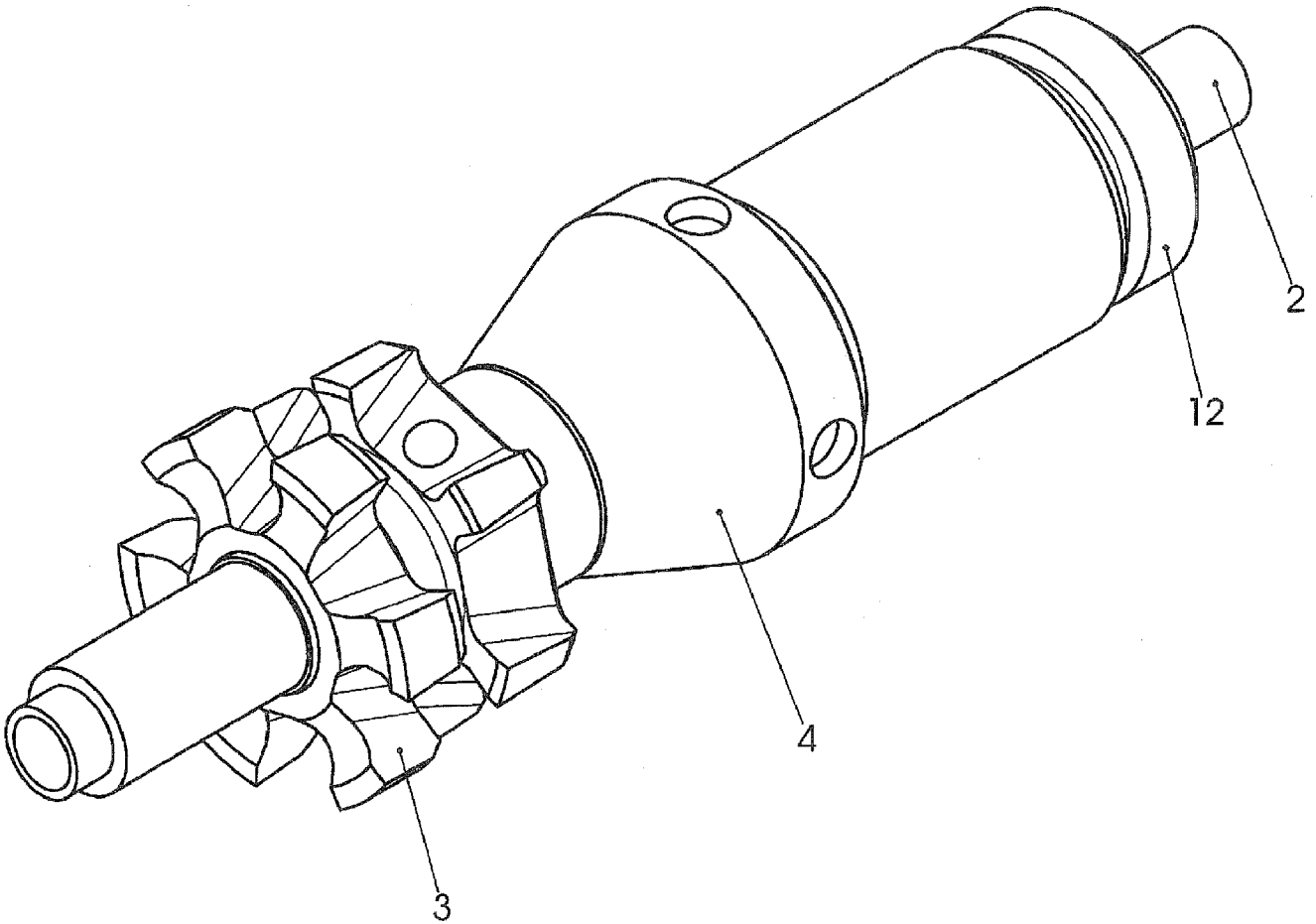
FIG. 6 shows a fourth embodiment of a boring head according to the invention in a perspective view.
Figure 7:
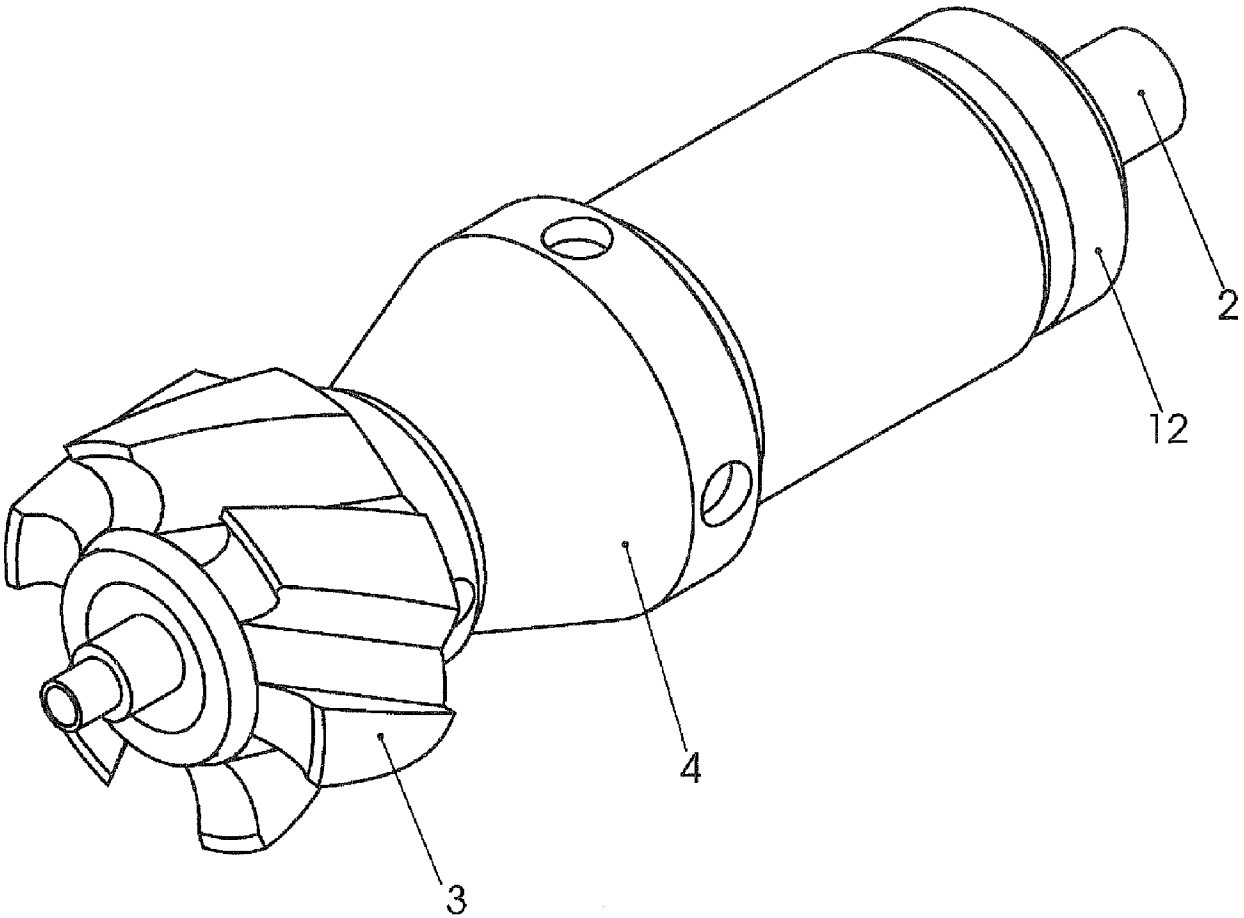
FIG. 7 shows a fifth embodiment of the boring head according to the invention in a perspective view.

The further embodiments according to FIGS. 5 to 7 show in particular different forms for the cutting ring 3. These different forms are in principle equally suitable for all embodiments according to the invention and in particular for the two embodiments according to FIG. 1 and respectively FIGS. 3 and 4.

The embodiment shown in FIG. 5 differs from the first embodiment in particular in the form of the blades. Said blades' edges are in particular of essentially trapezoidal design. The recesses are therefore given a U shape in contrast to the V-shaped recesses in the first embodiment.

In the embodiment shown in FIG. 6, the cutting ring consists of two halves, the blades of which are rotationally offset from one another. In this way, solid bodies that have not been shattered by the front cuffing ring half encounter the blades of the rear cutting ring half.

In the embodiment according to FIG. 7, the longitudinal edges of the blades run at an angle of about 45° to the longitudinal direction of the boring head or of the boring device.

What is claimed is:

1. A boring head, comprising at least three boring head sections, arranged to define in a boring direction a first boring head section located at a front of the boring head and formed with discharge passages for directing soil loosened by the first boring head section rearwardly, said discharge passages being arranged in circumferential spaced-apart relationship to define blades there between, with the blades having a front end face extending perpendicular to a longitudinal axis of the boring head, a second boring head section following the first boring head section and having an outer surface formed with largely conical sections which rise in opposition to the boring direction, and a third boring head section having a base, said base fastening the boring head to a housing of a ground-boring device that displaces earth with a percussive action, wherein the front end face of the blades is sized to extend radially beyond a forward end of the second boring head section.

2. The boring head of claim 1, wherein the discharge passages of the first boring head section are dimensioned to provide a multiplicity of radially arranged blades.

3. The boring head of claim 2, wherein the blades have front edges which are oriented essentially perpendicular to a longitudinal axis of the boring head.

4. The boring head of claim 2, wherein the blades have a trapezoidal configuration.

5. The boring head of claim 1, wherein the third boring head section is connected to the housing in a positive-locking manner.

6. The boring head of claim 1, wherein the third boring head section is welded to the housing.

7. The boring head of claim 1, wherein the boring head has one or more fluid outlets at least at a location selected from the group consisting of in front of and in the region of the second boring head section.

8. The boring head of claim 1, wherein the discharge passages are arranged at an angle of between 0° and 45° to a longitudinal axis of the boring head.

9. The boring head of claim 1, wherein the discharge passage has a V-shaped configuration.

10. The boring head of claim 1, wherein the first boring head section has two cutting rings having respective ones of the discharge passages to thereby form a multiplicity of radially arranged blades, the two cutting rings being rotationally offset from one another, so that discharge passages of one of the cutting rings are in alignment with the blades of the other one of the cutting rings.

11. A boring head for a ground-boring device displacing earth with a percussive action, comprising at least three boring head sections arranged in a boring direction to define a first boring head section located at a front of the boring head and formed with discharge passages for directing soil loosened by the first boring head section rearwardly, said discharge passages being arranged in circumferential spaced-apart relationship to define blades there between, with the blades having a front end face extending perpendicular to a longitudinal axis of the boring head, a second boring head section following the first boring head section and having an outer surface formed with largely conical sections, which rise in opposition to the boring direction, and a third boring head section having a base fastening the boring head to a housing of the ground-boring device, wherein at least two of the boring head sections are movable axially relative to one another with respect to a longitudinal axis of the boring head, wherein the front end face of the blades is sized to extend radially beyond a forward end of the second boring head section.

12. The boring head of claim 11, wherein the first boring head section and the second boring head section are axially fixedly connected to one another in a direction of the longitudinal axis of the boring head, and the third boring head section is movable relative to said first and second boring head sections.

13. The boring head of claim 11, wherein the second boring head section and the third boring head section are axially fixedly connected to one another in the direction of the longitudinal axis, and the first boring head section is movable relative to said second and third boring head sections.

14. The boring head of claim 11, wherein the discharge passages of the first boring head section are dimensioned to provide a multiplicity of radially arranged blades.

15. The boring head of claim 14, wherein the blades have front edges which are oriented essentially perpendicular to the longitudinal axis of the boring head.

16. The boring head of claim 14, wherein the blades have a trapezoidal configuration.

17. The boring head of claim 14, wherein the first boring head section has two cutting rings, each having respective discharge passages, to thereby form a multiplicity of radially arranged blades, the two cutting rings being rotationally offset from one another, so that discharge passages of one of the cutting rings are in alignment with the blades of the other one of the cutting rings.

18. The boring head of claim 11, wherein the first boring head section has a diameter which essentially corresponds to a diameter of the housing.

19. The boring head of claim 11, wherein the first boring head section has a largest diameter which is greater than a smallest diameter of the second boring head section.

20. The boring head of claim 11, wherein the first boring head section has a percussion bolt guided in at least one of the second boring head section and the third boring head section.

21. The boring head of claim 20, wherein the percussion bolt has a chisel point projecting into the earth.

22. The boring head of claim 20, wherein the percussion bolt has a contact surface which is first struck by a percussion piston and, after a further forward movement, the percussion piston strikes a contact surface of one member selected from the group consisting of the second boring head section, the third boring head section, and the housing.

23. The boring head of claim 20, wherein the percussion bolt has a contact surface which strikes a contact surface of one member selected from the group consisting of the second boring head section, the third boring head section, and the housing after a forward movement.

24. The boring head of claim 11, wherein the third boring head section is connected to the housing in a positive-locking manner.

25. The boring head of claim 11, wherein the third boring head section is welded to the housing.

26. The boring head of claim 11, wherein the boring head has one or more fluid outlets at least at one location selected from the group consisting of in front of and in the region of the second boring head section.

27. The boring head of claim 11, wherein the discharge passages are arranged at an angle of between 0° and 45° in relation to the longitudinal axis of the ground-boring device.

28. The boring head of claim 11, wherein the discharge passages have a V-shaped configuration.

29. A method of producing a ground bore by using a boring head on a displacement ground boring device, comprising the steps of:

loosening earth by moving a first boring head section located at the front of the boring head in a forward direction by percussive action of the ground boring device, said first boring head section having discharge passages for directing soil loosened by the first boring head section rearwardly, said discharge passages being arranged in circumferential spaced-apart relationship to define blades there between, with the blades having a front end face extending perpendicular to a longitudinal axis of the boring head;

providing radial displacement of the earth with low resistance to motion using a second boring head section in the forward direction by percussive action of the ground boring device, said second boring head section following the first boring head section and having largely conical sections on an outer surface of the second boring head section, said largely conical sections rising against the boring direction; and moving a third boring head section having a base fastened to a housing of the ground-boring device wherein the front end face of the blades is sized to extend radially beyond a forward end of the second boring head section.

30. The method of claim 29, further comprising the step of axially moving at least two of the boring head sections relative to one another with respect to the longitudinal axis of the boring head.

* * * * *